US005127314A

United States Patent [19]

Swain

[11] Patent Number: 5,127,314

[45] Date of Patent: Jul. 7, 1992

[54] COMPENSATING CAM SOCKET PLATE TORQUE RESTRAINT ASSEMBLY FOR A VARIABLE DISPLACEMENT COMPRESSOR

[75] Inventor: James C. Swain, Columbus, Ohio

[73] Assignee: General Motors Corporation, Detroit, Mich.

[21] Appl. No.: 620,117

[22] Filed: Nov. 30, 1990

[51] Int. Cl.[5] ..... F01B 3/00; F01B 13/04

[52] U.S. Cl. ..... 92/DIG. 12.2; 92/71; 417/222 R; 417/269; 74/60

[58] Field of Search ..... 92/12.2, 71; 417/222, 417/222 S, 269; 74/60

[56] References Cited

U.S. PATENT DOCUMENTS 2,706,384 4/1955 Schott .
2,964,234 12/1960 Loomis .
3,292,554 12/1966 Hessler .
4,077,269 3/1978 Hodgkinson .
4,372,116 2/1983 Dineen .
4,428,718 1/1984 Skinner .
4,480,964 11/1984 Skinner .
4,683,765 8/1987 Miller ..... 417/222 S
4,815,358 3/1989 Smith .
4,875,834 10/1989 Higuchi et al. ..... 74/60

*Primary Examiner*—Thomas E. Denion
*Attorney, Agent, or Firm*—Ronald L. Phillips

[57] ABSTRACT

An assembly for providing socket plate torque restraint for a variable displacement wobble plate compressor is provided. Swing arms support a guide pin and allow for swinging motion to be directed to the pin. A translatable driving sleeve is attached to and rotates with the compressor drive shaft. The sleeve is formed with a cam section having a variable axial profile. An axially fixed follower cooperates with the cam section to generate the motion of the guide pin relative to the socket plate. The motion defines a motion of the socket plate which produces no inertial torques. The compensating torque restraint smooths the uneven driving action of the socket plate. The position of the cam section varies in relation to the displacement orientation of the socket plate, thus allowing precisely that socket plate motion, at all stroke positions, which produces no inertial torques.

2 Claims, 3 Drawing Sheets

COMPENSATING CAM SOCKET PLATE TORQUE RESTRAINT ASSEMBLY FOR A VARIABLE DISPLACEMENT COMPRESSOR

TECHNICAL FIELD

The present invention relates generally to variable displacement compressors, and more particularly, to an improved assembly for providing socket plate torque restraint for a variable displacement wobble plate compressor.

BACKGROUND OF THE INVENTION

A popular type of refrigerant compressor for use in vehicle air conditioning systems involves a wobble or nutating drive mechanism to provide infinitely variable displacement. In this type of compressor, a plurality of cylinders are equally angularly spaced about a cylinder block and housing, and equally radially spaced from the axis of a central drive hub. A piston is mounted for reciprocating motion in each of the cylinders. A piston rod connects each piston to a non-rotatable socket or wobble plate that provides the nutating motion in response to a rotating drive shaft included in the central drive hub. The driving of the socket plate in a nutating path serves to impart the linear reciprocating motion to the pistons, thereby providing proper compressor operation. By varying the angle of the socket plate relative to the drive hub, through internal refrigerant gas pressure, the stroke of the pistons and, therefore, the displacement or capacity of the compressor is varied.

The action of the nutating socket plate in the refrigerant compressor inherently results in it being subjected to torque. In order for the compressor to properly function, the torque applied to the socket plate must be properly restrained; i.e. an equal and opposite torque must be transmitted to a fixed structure, such as to the compressor housing. A common method of restraining torque found in prior art socket plate compressors involves the use of a guide pin/slider assembly, such as that disclosed in U.S. Pat. No. 4,480,964 to Skinner, issued Nov. 6, 1984. The guide pin is fixed to the cylinder block and a ball guide is slidably mounted thereon and retained on the socket plate. The guide pin thus prevents the socket plate from rotating with the rotary drive plate and allows the torque applied to the socket plate to be restrained by transmitting an equal and opposite torque through the cylinder block to the fixed housing.

This torque restraint design undesirably produces torsional oscillations. It can be appreciated that the axis of the socket plate does not coincide with the axis of the drive hub, but rather varies through a variety of angular positions with respect to the drive hub as it travels in its nutating path. As a result of the variation of the angular relationship between the drive hub and the socket plate, as the non-rotating socket plate wobbles or nutates, a torsional acceleration and deceleration action results in the drive shaft. The torsional oscillation resulting from the alternating acceleration and deceleration of the drive shaft occurs twice per drive hub revolution. This torsional oscillation creates undesirable vibration within the compressor.

While this prior art torque restraint design has thus proved generally effective, there is some need for improvement to alleviate the vibration problem. More specifically, there is a need to provide a mechanism that prevents socket plate rotation without inducing torsional oscillation in the drive shaft.

One alternative to solving this problem is disclosed in two co-pending U. S. applications assigned to the assignee of the present invention. These applications are entitled RZEPPA JOINT SOCKET PLATE TORQUE RESTRAINT ASSEMBLY FOR A VARIABLE DISPLACEMENT COMPRESSOR, filed Apr. 5, 1990, Ser. No. 07/504,817 and CROSS GROOVE JOINT SOCKET PLATE TORQUE RESTRAINT ASSEMBLY FOR A VARIABLE DISPLACEMENT COMPRESSOR, filed Oct. 1, 1990, Ser. No. 07/591,993. Both of these applications broadly disclose the use of a constant velocity joint to restrain the socket plate motion relative to the drive mechanism, and thus prevent vibration.

The constant velocity joint alternative is very promising as a socket plate torque restraint design. It is desirable, however, to provide another design alternative that may be utilized with a guide pin/slider assembly to uniformly restrain the driving torque applied to the socket plate. This torque restraint mechanism would prevent rotation of the socket plate that is positioned and driven by an angled journal of a drive hub in a manner such that the inertial torque reaction of the socket plate about the axis of the drive hub and shaft is zero at any instant. The socket plate torque restraint mechanism would produce a reacting action transmitting the driving torque applied to the socket plate and carry it to a fixed structure within the compressor assembly. Such a socket plate torque restraint mechanism would substantially eliminate higher order vibration, while effectively transmitting a restraining torque from the socket plate to the fixed compressor housing. It would be easy to manufacture and be substantially failure-proof, providing a long service life.

SUMMARY OF THE INVENTION

Accordingly, it is a primary object of the present invention to provide a socket plate torque restraint mechanism that prevents socket plate rotation while substantially eliminating torsional vibration of the compressor.

It is an additional object of the present invention to provide an assembly that reacts or transfers the driving torque applied to the socket plate to the compressor body without inducing inertial torques.

It is still another object of the present invention to provide an assembly that uniformly restrains the socket plate motion relative to the drive mechanism.

Still another object of the present invention is to provide a socket plate torque restraint mechanism that allows the refrigerant compressor to operate at higher speeds while minimizing torsional vibrations.

It is a further object of the present invention to provide a socket plate torque restraint assembly that achieves a substantially ideal kinematic restraint action at any stroke position of the compressor.

It is an additional object of the present invention to provide a socket plate torque restraint assembly that substantially eliminates the inertial torque acting on the drive shaft and that is less costly to machine, assemble and maintain.

A still further object of the present invention is to provide a socket plate torque restraint mechanism that does not generate frictional heat and substantially eliminates operational wear, thus providing for a long service life and minimizing the chance of catastrophic failure.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved socket plate torque restraint assembly for a variable displacement socket or wobble plate compressor is provided. The socket plate torque restraint assembly offers the desirable quality of uniformly restraining the socket plate motion relative to the drive mechanism. This eliminates the normal inertial torque acting on the drive hub/shaft, thus eliminating torsional oscillation or vibration of the drive hub/shaft and smoothing the rotating action. The assembly further cooperates with the translational axial motion of the socket plate and drive journal as they operate through the entire range of displacement positions to accomplish its restraint function.

In its broadest aspects, the torque restraint mechanism includes a cam and follower assembly mounted for relative translation within the compressor. The assembly is used to react or transfer the driving torque applied by the driving journal to the socket plate to the compressor housing. The torque is directed to a guide pin and then transmitted to the fixed compressor housing. The inertial torque that would react on the drive shaft at twice per revolution in prior art compressor operation is now eliminated so as to avoid the torsional acceleration and deceleration, substantially eliminating operational vibration.

The variable displacement compressor in which the restraint assembly of the present invention is particularly adapted for use includes a compressor housing and a cylinder block including five axially aligned cylinder bores. Five pistons are slidingly engaged for reciprocal motion within these cylinder bores. The reciprocating action of the pistons is utilized to compress the refrigerant. The compressed refrigerant is then further utilized by the air conditioning system to condition the air being directed to the vehicle interior before cycling back to the compressor. It can be appreciated that a greater or lesser number of pistons with associated bores may be utilized.

A central drive shaft is axially aligned within the compressor housing. The drive shaft extends outside the cylinder block to engage a driving component of a vehicle engine (not shown) imparting the required rotary motion.

A socket plate/journal assembly is supported by the drive shaft and provides for variable angle adjustment. The journal is mounted for rotation with the drive shaft and drives the non-rotating socket plate in a nutating path depending on the adjusted angle. The socket plate is prevented from rotating along with the journal by the guide pin mounted between the cylinder block and compressor housing. As the journal rotates, it imparts the nutating motion to the socket plate. The pistons are connected to the socket plate, and thus a desirable back and forth or linear reciprocating motion is imparted to the pistons. The total stroke of the pistons and thus the compressor displacement is dependent on the adjusted angle of the socket plate/journal assembly.

The socket plate engages the guide pin through a spherical slider or ball guide mounted thereon. The ball guide is retained in the socket plate for radial movement. Thus, as the socket plate undergoes angular travel relative to the guide pin, the ball guide accommodates the travel while moving radially relative to the socket plate to maintain proper retaining position.

The journal is pivotally connected to a driving sleeve that is slidably mounted for axial movement along the drive shaft. The sleeve translates along the drive shaft as the socket plate/journal assembly angulates between full displacement and zero displacement positions. This translational motion of the sleeve assists in the restraint function of the present invention, as will be more particularly described below.

The drive shaft is drivingly connected to the journal and the driving sleeve by a lug that extends freely through a longitudinal slot in the driving sleeve to allow the axial movement. The journal is pivotally attached to the driving sleeve by a trunnion or spaced pivot pin arrangement. The drive lug is provided with a kidney shaped guide slot for guiding the angulation of the socket plate/journal assembly. The drive lug engages an ear formed integral with the journal and supporting a drive pin; the pin being slidable in and guided by the guide slot as the sleeve moves along the drive shaft in response to angulation of the socket plate/journal assembly.

As mentioned above, the cam and follower assembly forms an important part of present invention. Specifically, the driving sleeve is formed with a cam section that cooperates with a follower to generate the desired motion of the guide pin so that the socket plate inertial torques are eliminated. The follower is pivotally mounted in a plane parallel to and adjacent the inside face of the cylinder block. The operative cam surface of the cam section has an axially variable dual-lobed character. More particularly, at the distal end (adjacent the cylinder block), the section has a prominent oval-shaped or elliptical profile (when viewed in section). The elliptical profile gradually becomes more subtle as the sleeve transitions back toward the body of the sleeve. The profile eventually becomes substantially circular when viewed in section, providing a neutral, cam surface at its proximal end (adjacent the body of the sleeve). Since the follower is axially fixed, the motion resulting from its engagement with the cam section is a function of the axial position. In order to accommodate the sleeve and cam section translation, the cylinder block is formed with a coaxial bore.

Each of the infinite number of angular positions of the socket plate/journal assembly has an associated cam profile on the cam section of the sleeve. As the socket plate/journal assembly angulates through its range of positions, the sleeve simultaneously translates to place the corresponding and desired cam section profile in operative engagement with the follower. The dual-lobed design of the cam section advantageously creates an accelerating and decelerating motion in the follower that is directed to the guide pin. This motion of the drive pin allows the socket plate to move in such a manner that it produces no inertial torques on the restraint means. Accordingly, as the sleeve rotates with the drive shaft, the drive torque is reacted to the compressor housing, free of any inertial torques.

According to the invention, a radial vector of the nutating socket plate must be allowed to follow a lemniscate or "figure 8" motion in order to avoid torsional inertial forces. For a variable stroke machine the size and location of this "figure 8" varies. This invention provides precisely the desired "figure 8" motion for all stroke positions, and thus eliminates vibration.

To operationally accept the restraint torque, the guide pin is mounted on a cradle integral with the follower for oscillating or rocking motion within the compressor housing. The oscillating motion is transmitted to the socket plate to eliminate the uneven action generated by current restraint means.

In operation, the sleeve and integral cam section rotates with the drive shaft and translates along the shaft, and thus varies the exact cam profile that is engaged by the follower. At full compressor displacement, the follower engages the most prominent elliptical profiled portion, generating the greatest motion of the pin. Conversely, at zero displacement the follower engages the circular or zero profiled portion of the cam section, thus remaining essentially stationary and no motion of the pin results.

The restraint technique provided by the present invention results in elimination of the torsional acceleration and deceleration associated with the drive shaft during prior art compressor operation. The translational and variable cam sleeve design allows a motion of the socket plate which produces no inertial torques. Thus, the inertial torque, and resulting torsional oscillation, experienced by the drive shaft of the prior art arrangements is substantially eliminated, likewise substantially eliminating undesirable vibration within the compressor.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
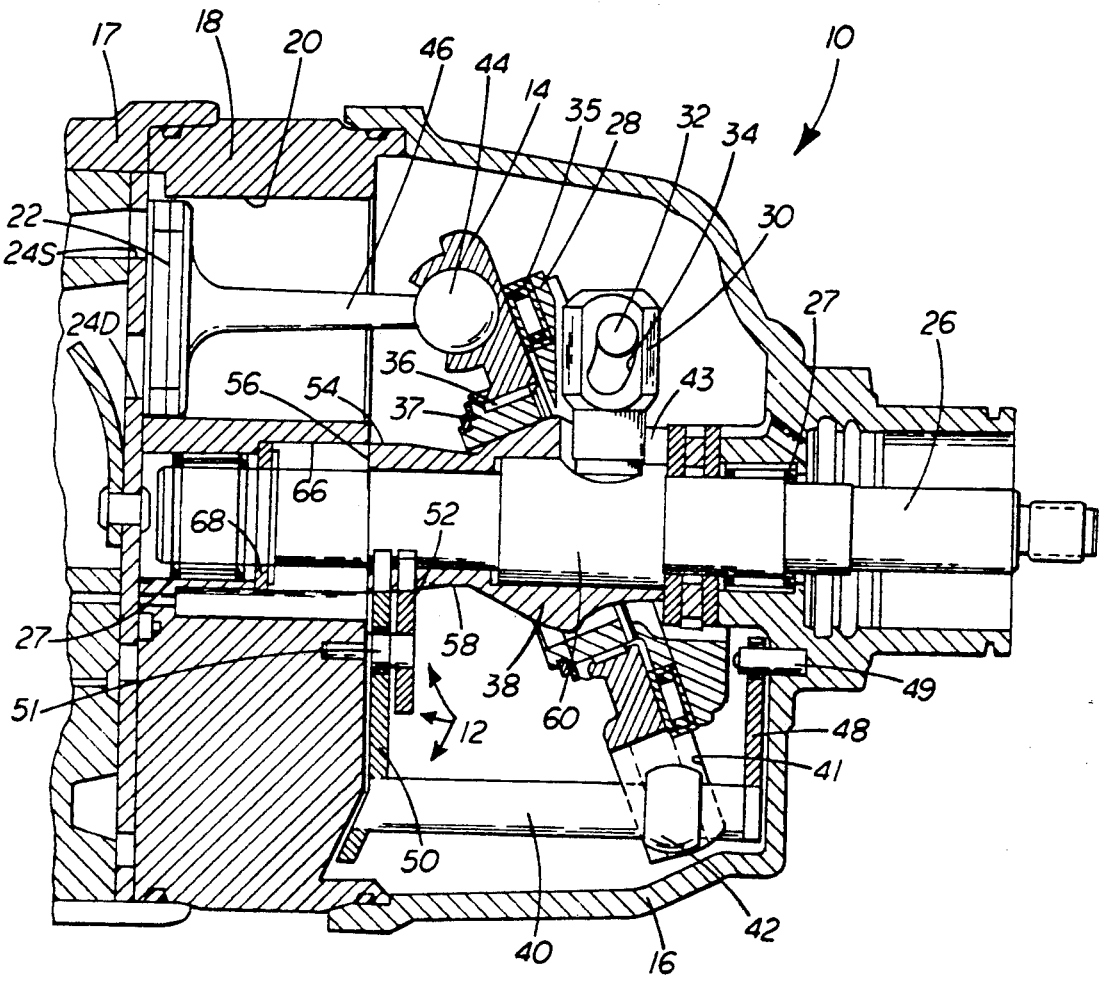
FIG. 1 is a partial cross-sectional view of the variable displacement socket plate compressor including the improved socket plate torque restraint assembly of the present invention, showing full compressor displacement.
Figure 2:
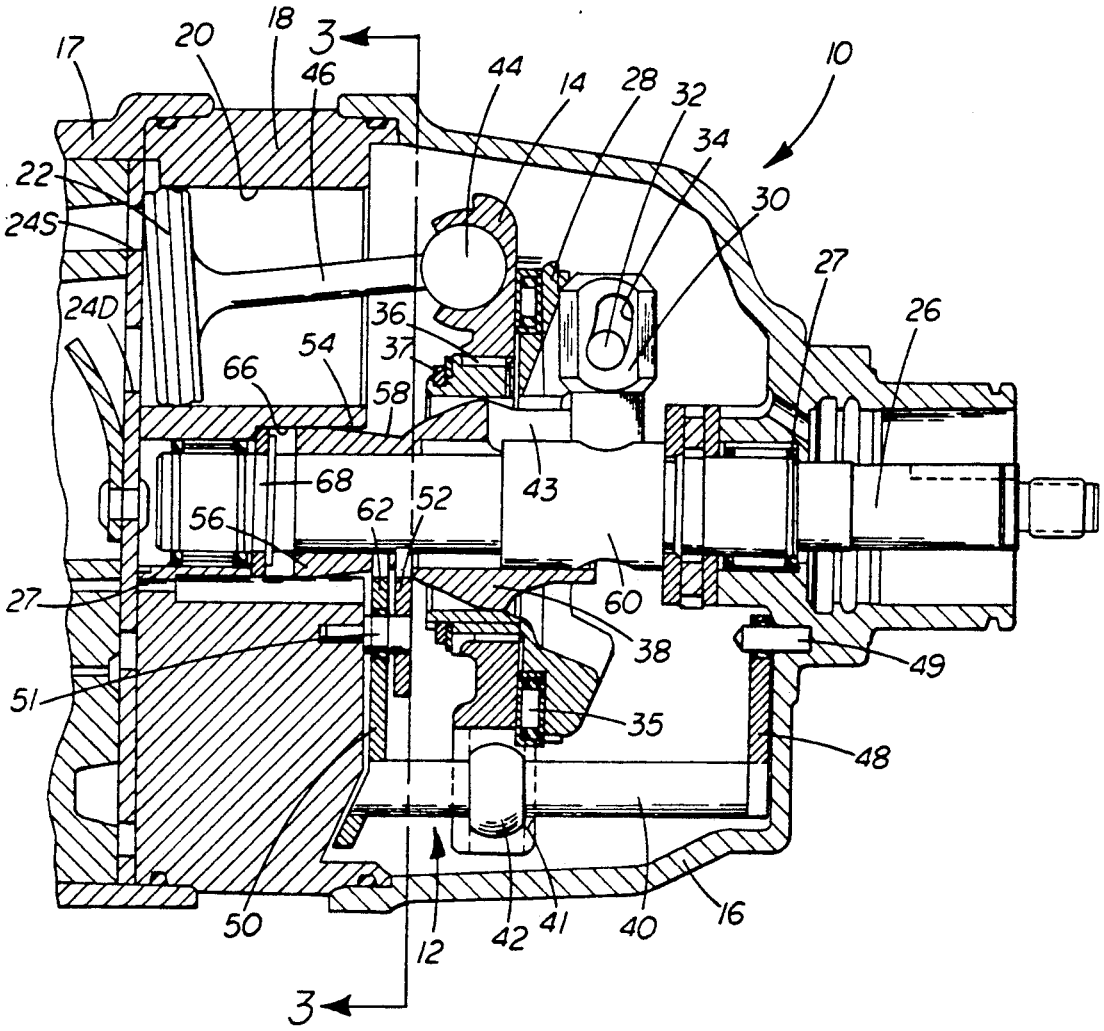
FIG. 2 is a partial cross-sectional view of the variable displacement socket plate compressor including the improved socket plate torque restraint assembly of the present invention, showing zero compressor displacement.

Reference is made to FIGS. 1 and 2 illustrating a variable displacement socket plate compressor 10 including an improved socket plate torque restraint assembly 12 constructed in accordance with the teachings of the present invention. As will be appreciated from a review of the following description in conjunction with the drawings of the preferred embodiment, the restraint assembly 12 efficiently counteracts and transmits torque from a socket plate 14 of the compressor 10 to the compressor housing 16 while substantially reducing torsional vibrations.

The compressor 10 also includes a head 17 and a cylinder block 18 having a plurality of cylinder bores 20 (only one shown in FIGS. 1 and 2). The present invention is shown as being used in a refrigerant compressor having five cylinder bores 20 (see FIG. 3). However, it can be appreciated that vehicle refrigerant compressors can be designed with a fewer or greater number of cylinder bores 20.

A piston 22 is slidingly engaged for reciprocable motion within each of the cylinder bores 20. The reciprocating action of the pistons 22 compresses the refrigerant. The compressed refrigerant passes through discharge ports 24D of the compressor 10, and after further processing, is utilized by the air conditioning system of the vehicle (not shown) to condition or cool air being directed to the vehicle interior. The refrigerant is returned to the compressor through suction ports 24S to complete the cycle.

A drive shaft 26 is axially aligned with the cylinder block 18 at the opposite end of the compressor housing 16. Needle bearings 27 mount the drive shaft 26 for rotation and it extends externally of the compressor housing 16 to engage the drive mechanism of the automobile engine (not shown). During engine operation, power is transmitted from the engine to the drive shaft 26 which in turn rotates to operate the compressor 10.

A drive journal 28 is positioned to provide the actual driving action to reciprocate the pistons 22. To accomplish this purpose, the journal 28 is connected to the drive shaft 26 through a drive lug 30. A drive pin 32 is retained on an ear (not shown) of the journal 28 and is slidably received in a kidney-shaped guide slot 34 in the drive lug 30. The engagement between the journal 28 and the drive lug 30 thus forces the journal 28 to rotate with the drive shaft 26.

The socket plate 14 is in juxtaposition with the journal 28; the journal being mounted for relative rotation through an annular thrust bearing 35. The socket plate 14 is further supported by a needle bearing 36 and is retained on the journal 28 by a snap ring 37.

Compressor displacement is determined by the angular position of the socket plate 14/journal 28 assembly relative to the drive shaft 26. The angulation of the assembly is permitted by the pivotal connection of the journal 28 to a driving sleeve 38 slidably mounted for axial translation on the drive shaft 26. A pair of pivot pins (not shown) are mounted in opposite sides of the journal 28 and engage the sleeve 38 to form a trunnion mount that allows the journal to angulate through its range of displacement positions. The sleeve 38 thus rotates with the shaft 26 and translates in response to the angulation of the socket plate 14/journal 28 assembly. The sleeve 38 further assists in the torque restraint function, as will be described in greater detail below.

The socket plate 14 is prevented from rotating with the journal 28 by its connection to a guide pin 40 mounted in the compressor housing 16. More specifically, the socket plate 14 includes a radial slot 41 that receives a spherical ball guide or slider 42 mounted for radial as well as pivotal movement. As the compressor displacement varies between full stroke position and zero stroke position, the ball guide 42 cooperatively translates along the guide pin 40. The ball guide 42 thus maintains its desired retaining position on the socket plate 14 as the latter angulates through its range of displacement positions. Since rotation is constrained, the socket plate 14 is thus allowed the desired wobble or nutating action.

In operation, as the drive shaft 26 is driven, the drive lug 30 extending through a longitudinal slot 43 in the driving sleeve 38 rotates in concert. Through the drive pin 32 connecting the lug 30 and journal 28, the journal is freely rotated. This rotation in turn is capable of imparting a nutating motion to the non-rotary socket plate 14. The angle of the journal 28 to the drive shaft 26 can be varied, thus determining the precise path traveled by the socket plate 14. More specifically, when the journal 30 is positioned at a substantially maximum angle, as shown in FIG. 1, the nutating motion of the socket plate 14 is at a maximum. Thus, in this orientation, and considering the connection of each piston 22 to the socket plate 14 through a ball 44 of a piston rod 46, it should be appreciated that the pistons 22 are reciprocated through their full stroke. As a result, the compressor 10 operates at full stroke displacement or maximum capacity.

Conversely, when the journal 28 is adjusted so as to be substantially perpendicular to the drive shaft 26, as shown in FIG. 2, the journal 28 spins without imparting nutating motion to the socket plate 14. The pistons 22 do not reciprocate in this operative situation. Thus, the operation of the compressor 10 is effectively terminated at this position. It can be appreciated that by infinitely varying the angle of the journal 28 anywhere between these two extremes, the operation of the compressor 10 at an infinite number of intermediate capacity levels may be achieved.

It can be appreciated that while the non-rotary socket plate 14 is traveling in its nutating path, it is being subjected to torque as a result of the driving force exerted by the rotating journal 28. Proper operation of the compressor 10 mandates that the socket plate torque be restrained. More particularly, a torque equal and opposite to the torque applied to the socket plate 14 must be transmitted to ground, i.e. a fixed structure such as the compressor housing 16. The assembly of the present invention efficiently accomplishes this important task. The inventive assembly substantially eliminates the inertial torque acting on the drive shaft 26, thus allowing the compressor 10 to operate at higher speed and substantially without vibration.

Figure 3:
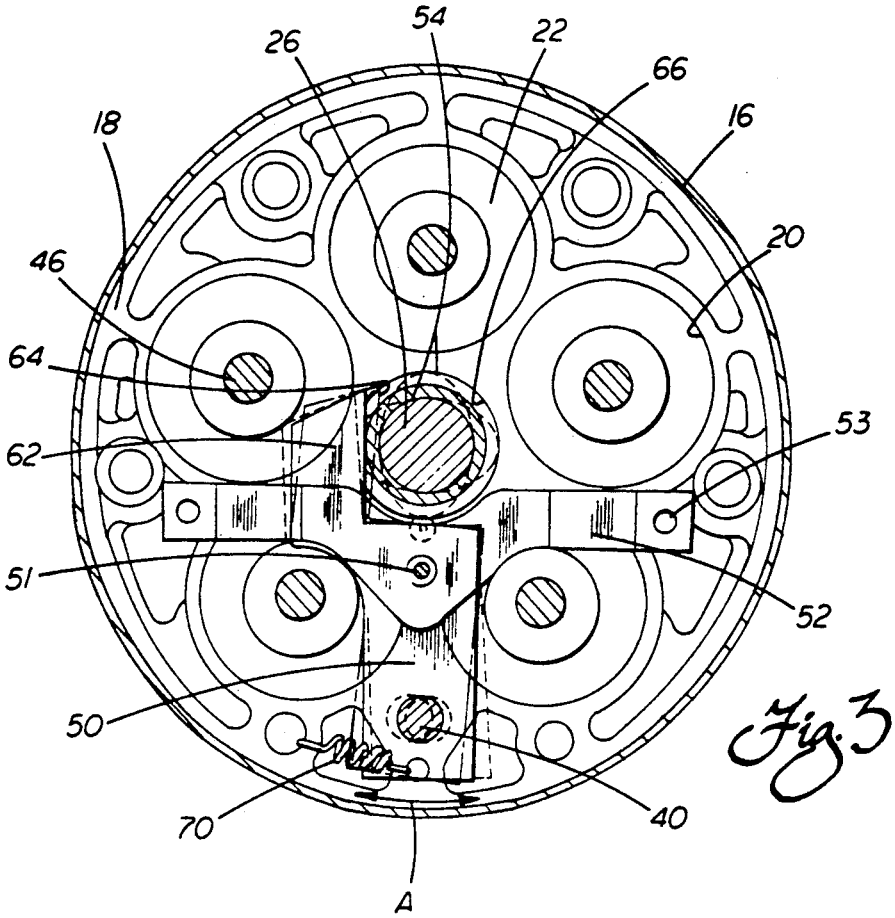
FIG. 3 is a cross-sectional view of the compressor taken along the lines 3—3 in FIG. 2, showing the cam and follower assembly in various positions.

In order to accomplish the desired function, the present invention contemplates mounting the guide pin 40 to allow it to oscillate. The pin 40 is carried by a swing arm 48 at one end adjacent the compressor housing 16. The arm 48 swings about a swing pin 49 mounted in the housing 16. A swing arm 50 likewise carries the guide pin 40 at a second end adjacent the cylinder block 18. A pivot pin 51 supports the arm 50 between the cylinder block 18 and a cross mounting plate 52. Pivot pins 49 and 51 are located on a common axial centerline. As shown in FIG. 3, the mounting plate is attached to the cylinder block by bolts 53. Together, the swing arms 48, 50 act as a cradle to allow the beneficial rocking motion of the guide pin 40. A cam and follower assembly (further described below) is utilized to oscillate the guide pin 40 and allow a motion in the socket plate 14 which produces no inertial torques.

In an important aspect of the invention, an operative cam section 54 is formed on the translational drive sleeve 38. The cam section 54 extends between a distal end 56 adjacent the cylinder block 18 and a proximal end 58 adjacent the body of the sleeve. The body of the sleeve 38 mounts the pivot pins that form the trunnion mount and is slidably carried on the enlarged portion 60. The drive lug 30 extends through the longitudinal slot 43 in the body. The cam section 54, being integral with the sleeve 38, rotates with the drive shaft 26 and cooperates with a follower 62 that is integral with the swing arm 50 (see FIG. 3). The follower 62 is thus operative to oscillate the swing arms 48, 50 and, in turn, oscillate the guide pin 40.

More specifically, the follower 62 has an inner flat face 64 that engages the cam section 54 of the sleeve 38. A tension spring 65 may be attached to the swing arm 50 and anchored to the cylinder block 18 to constantly urge the follower 62 to engagement with the cam section 54. Thus, as the face 64 of the follower 62 engages the cam section 54 under the force of the spring 65, the follower moves responsely. The follower 62/swing arm 50 oscillates about the pivot pin 51 and the guide pin 40 oscillates or swings in pendulum-like fashion in response, thus allowing the motion of the socket plate 14 to smooth the driving action. The motion created by the cam and follower assembly and directed to the guide pin 40 is generally indicated by action arrows A in FIG. 3.

Figure 4A:
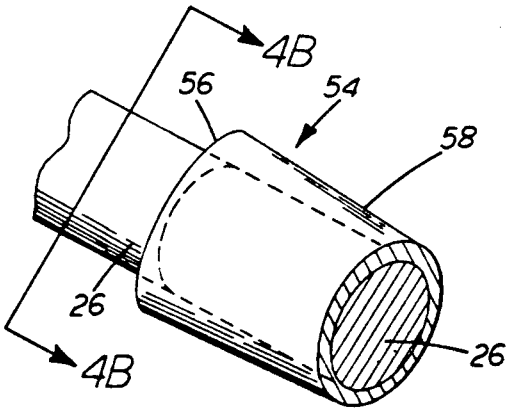
FIG. 4A is a perspective view of the cam section of the sleeve of the present invention showing its variable axial nature as the cam surface transitions from a prominent elliptical profile to a circular, neutral profile.
Figure 4B:
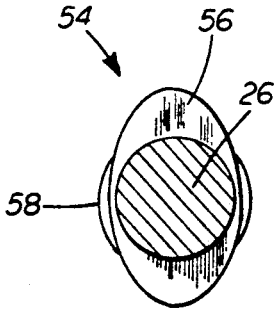
FIG. 4B is an end view of the cam section of the sleeve of the present invention taken along the lines 4*b*–4*b* in FIG. 4A, particularly showing the dual-lobed character of the cam profile.

Advantageously, the cam section 54 has a variable axial character, as best shown in FIG. 4A. More particularly, when viewed in section, the section 54 at its distal end 56 has a prominent oval-shaped or elliptical profile (see FIG. 4B). As the section 54 transitions toward the proximal end 58, the elliptical profile becomes gradually less pronounced. At the proximal end 58, the profile is substantially circular as shown in FIG. 4A. In other words, the greatest major axis dimension and the smallest minor axis dimension of the elliptical profile is at the distal end 56. As the section 54 progresses towards the proximal end 58, the major axis dimension decreases and the minor axis dimension increases (see FIG. 4B). Thus, as the section 54 approaches the proximal end 58, the elliptical profile becomes more subtle until it transitions to a circular profile at the end 58. The circular profile at the end 58 defines a neutral portion of the cam section 54 that does not generate a responsive motion in the follower 62.

It can be appreciated that the lobes of the elliptical profile of the cam section 54 acting against the follower 62 cause an accelerating and decelerating action. The lobes generate the acceleration/deceleration twice per shaft revolution and thus allow the desired socket plate motion which produces no inertial torques. Accordingly, the restraint technique created by the cam and follower assembly eliminates the potential for uneven forces in both amount and timed character, effectively eliminating the torsional oscillation of the shaft 26.

The translational nature of the sleeve 38 plays a vital part in the torque restraint function of the assembly 12. The response motion of the follower 62 as it engages rotating cam section 54 allows precisely that motion of the socket plate 14 which produces no inertial torques at any angle of operation. This is best shown in FIGS. 1 and 2 where the cam section 54 is depicted in different axial positions.

In order to accommodate the translating cam section 54 on the sleeve 38, a coaxial bore 66 is formed in the cylinder block 18 to receive a substantial portion of the section 54 as the compressor 10 approaches zero displacement operation (see particularly FIG. 2). A thrust stop washer 68 is provided to axially restrain the distal end 56 of the cam section 54 in the bore 66.

In operation, as the journal 28 drives the socket plate 14, imparting the driving torque, the cam and follower assembly reacts this torque to the housing via the guide pin 40. At full compressor displacement, the angle between the drive shaft 26 and the socket plate 14/journal 28 assembly is at its most extreme. It is at this position that the greatest motion of the guide pin 40 is required. The sleeve 38 assumes the axial position shown in FIG. 1 so that the follower 62 engages the cam section 54 at its most extreme elliptical profile. The follower 62 is thus moved through its greatest range, oscillating the guide pin 40 on the swing arms 48, 50 to its greatest extent. Accordingly, the socket plate 14 is allowed to move without generating inertial torques.

As the compressor displacement approaches an intermediate orientation between full piston stroke and zero piston stroke, the angle between the drive shaft 26 and the socket plate 14/journal 28 assembly decreases. At this reduced stroke the motion required of the guide pin 40 is also reduced. To accommodate the reduced requirement, the cam section 54 slides axially into the bore 66 of the cylinder block 18 as the joint angle is reduced. The axial translation positions the cam section 54 so that a less pronounced elliptical profile is engaged by the follower 62. The guide pin 40 motion is thus precisely that which allows the socket plate 14 to move without producing inertial torques.

At zero compressor displacement, the socket plate 14/journal 28 assembly is substantially perpendicular to the drive shaft 26. In this orientation, the journal 28 spins freely without imparting nutating motion to the socket plate 14. Thus, the driving torque is effectively eliminated when in this position and no significant compensating restraint torque is needed. As the socket plate 14/journal 28 assembly angulates to this position, the cam section 54 is urged to its extreme position with the distal end 56 adjacent the thrust stop washer 68 [BB within the bore 66. At this position, the cam section 54 exposed to the follower 62 is defined by the circular, neutral cam profile. The follower 62 thus remains essentially stationary and does not impart an oscillating motion to the guide pin 40. At this position the socket plate is free of inertial torques without requiring motion of the drive pin.

In summary, numerous benefits are obtained by use of the present invention. As described above, it can be visualized that the socket plate torque restraint assembly 12 including the cam and follower assembly and swingably mounted guide pin 40 allows the drive torque to be reacted to the compressor body at all displacement positions without generating inertial torques from the socket plate 14. To do this, rotating cam section 54 of the sleeve 38, through the linked engagement with the follower 62, transmits the drive torque to the guide pin 40. The cam section 54 slides axially along the drive shaft 26 to vary the cam profile, and thence allow the precise motion of the socket plate 14 which produces no inertial torques.

The foregoing description of a preferred embodiment of the invention has been presented for purposes of illustration or description. It is not intended to be exhaustive to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. An assembly for providing socket plate torque restraint for a variable displacement wobble plate compressor having a fixed housing and including a driving sleeve mounted for translational motion along and rotation with a drive shaft, and a guide pin for restraining the rotation of said socket plate and transferring socket plate torque to said fixed housing, comprising:

cradle means for mounting said guide pin so as to allow swinging motion relative to said socket plate;

cam means formed on said driving sleeve, said sleeve translating along said drive shaft responsive to the displacement orientation of said socket plate; and follower means engaging said cam means, said cam means and follower means cooperating to generate said swinging motion, said swinging motion providing a socket plate motion which produces no inertial torques;

whereby said socket plate restraint is provided and torsional vibration is substantially eliminated.

2. An assembly for providing socket plate torque restraint for a variable displacement wobble plate compressor having a fixed housing and including a driving sleeve mounted for translational motion along and rotation with a drive shaft, and a guide pin for restraining the rotation of said socket plate and transferring socket plate torque to said fixed housing, comprising:

a pair of swing arms mounted within said compressor housing, each of said swing arms supporting an opposing end of said guide pin so as to allow swinging motion for said guide pin relative to said socket plate;

a cam section having a variable axial profile formed on said driving sleeve, said driving sleeve translating along said drive shaft in relation to the displacement orientation of said socket plate; and a follower engaging said cam section, said cam section and said follower cooperating to generate said swinging motion, said swinging motion providing a socket plate motion which produces no inertial torques, whereby said socket plate restraint is provided and torsional vibration is substantially eliminated.

* * * * *